US005863221A

United States Patent [19]

Castaldo

[11] Patent Number: 5,863,221

[45] Date of Patent: Jan. 26, 1999

[54] INSULATING ENCLOSURE TO PROVIDE A WATER-TIGHT SEAL WITH AN ELECTRIC CONNECTOR

[75] Inventor: Cosmo Castaldo, Westbury, N.Y.

[73] Assignee: Leviton Manufacturing Co., Inc., Little Neck, N.Y.

[21] Appl. No.: 899,128

[22] Filed: Jul. 23, 1997

[51] Int. Cl.[6] ..... H01R 13/40

[52] U.S. Cl. ..... 439/589

[58] Field of Search ..... 439/587, 588, 439/589, 460, 135, 282

[56] References Cited

U.S. PATENT DOCUMENTS 3,588,783 6/1971 Newman ..... 439/460

3,611,255 10/1971 Shroyer ..... 439/282

4,421,369 12/1983 Myking ..... 439/135

*Primary Examiner*—Neil Abrams

*Assistant Examiner*—Javaid Nasri

*Attorney, Agent, or Firm*—Paul J. Sutton

[57] ABSTRACT

A water-tight assembly of an electrical plug or receptacle with a weather-resistance insulating housing employs interlocking ribs on the interior of the housing and the exterior of the electrical connector. Additional ribs on the interior of the housing insures intimate engagement between these ribs and provides additional seals. A shroud on one of the housings permits the joiner of two housings in a water-tight manner and a closure cap supported on a tether provides a water-tight closure of the housing when not in use.

18 Claims, 4 Drawing Sheets

INSULATING ENCLOSURE TO PROVIDE A WATER-TIGHT SEAL WITH AN ELECTRIC CONNECTOR

BACKGROUND OF THE INVENTION

1. Field of the Invention

The invention is directed to the field of electrical connectors and more particularly to an insulated housing providing a water-tight seal for an electrical connector.

2. Description of the Prior Art

Known prior art devices depend upon the interface between the outer surface of the electrical connector and the inner surface of the housing to provide a water-tight seal for the connector. To be effective, the housing bore is smaller than the outer diameter of the connector so that the housing is dilated as the connector is forced into the housing bore and returns to its initial size and shape once the connector is in its desired position within the housing. Gaps between the housing and the connector will admit moisture which could lead to the distruction of the connector and render any connected system inoperative.

The patent to Swartz, U.S. Pat. No. 3,307,138 issued Feb. 28, 1967, shows a watertight repairable electric plug using an annular elastomeric waterproofing packing to seal the cable entrance into the plug and an elastomeric gasket between the end of the plug and the shield of a shield-type receptacle. The blade contact end of the plug is not water-tight if the plug is not attached to the receptacle.

In Buberniak, U.S. Pat. No. 3,624,591 issued Nov. 30, 1971, a front end seal or a seal about the plug blades is created during the molding phase. He states "Preferably, the main body portion 18 is molded from an electrically insulating material, such as polycarbonate or nylon, and the prongs 24 are imbedded in and integrally molded into the closed end portion 20 providing a seal-tight connection around the prongs to prevent any moisture from entering into the cup-shaped body portion 18 along the prongs." There is, however, no seal between the main body portion 18 and the end cap 60 and it could be possible for moisture to enter the connector assembly along the threaded connection between body portion 18 and the end cap 60.

Neither one of these patents show the use of a housing into which the plug or receptacle can be placed and which interlocks with such plug or receptacle to provide a water-tight seal thereabouts and further shows a closure plug to fully seal the entrance to the housing when no plug or receptacle engages the receptacle or plug in the housing.

The U.S. Pat. Nos, 3,984,168 issued Oct. 5, 1976; 3,989,340 issued Nov. 2, 1976 and 4,070,085 issued Jan. 24, 1978 show multi-part cap and connector assemblies which provide strain relief only to cables entering the assembly through the cover. No mention is made of providing a water-tight environment for the cap and connector.

U.S. Pat. No. 4,114,974 issued Sep. 19, 1978 and owned by the assignee of the patents in the previous paragraph shows the use of a sealing element which can provide a seal against entry of foreign material into the cap or connector.

SUMMARY OF THE INVENTION

The instant invention describes an external housing for an electrical plug or receptacle with means to interlock such plug or receptacle with such housing to provide a water-tight seal of such plug or receptacle not possible with prior art devices. A resilient housing has a bore therethrough from an open first end to a partially closed second end. Said bore having a relaxed diameter smaller than the diameter of the plug or receptacle assembly to be placed therein to provide intimate contact between the exterior surface of said plug or receptacle assembly and the interior surface of said housing as the dilated bore attempts to recover to its relaxed diameter. An annular recess in the back surface of an annular rib placed about the front of the plug or receptacle assembly interlocks with an annular rib and recess formed on the interior surface of the housing to provide a water-tight seal which prevents moisture from entering the housing along the surface of an installed assembly. An additional annular rib keeps the inter-locked ribs and recesses interlocked and provides a further seal.

When an external plug or receptacle is not engaging the installed assembly, the entire front end of the housing can be sealed with a closure plug. The closure plug has a circular body with an annular rib about a portion of its periphery. This rib is positioned between two ribs on the interior surface of the bore to hold the housing and closure plug in water-tight assembly. At a first end of the circular body is a cap having a diameter greater than that of the body and formed with an annular recess between the central body and the cap periphery. The recess receiving the end of the housing provides a first seal and the ribs retaining the closure plug in place forming additional seals. A tether connects the closure plug to the housing so that they are not separated when the plug is in use. A tab with a recess makes for easy removal of the plug from the housing. It is an object of the present invention to provide a novel water-tight connector system.

It is another object of this invention to provide a fully enclosed, novel, water-tight connector system.

It is still another object of this invention to provide a rim on the interior of a weather-resistant housing which mates with and interlocks with a further rim on the connector to provide a water-tight enclosure for such connector.

It is still a further object of this invention to provide a rim and at least one annular rib on the interior surface of a weather-resistant housing which mates with and interlocks with a further rim on the connector and engages said at least one annular rib to provide a water-tight enclosure for such enclosure.

It is yet another object to provide a novel water-tight connector system which has a closure plug to seal the entry to a weather-resistant housing when no external connector is inserted in said housing.

It is another object of this invention to provide a closure plug with an annular ridge about its body which interlocks with at least one rib on the interior of a weather-resistant housing to seal said housing when no external connector is inserted in said housing.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWING

In the drawings in which similar elements are given similar reference characters.

DESCRIPTION OF THE PREFERRED EMBODIMENT

Figure 1:
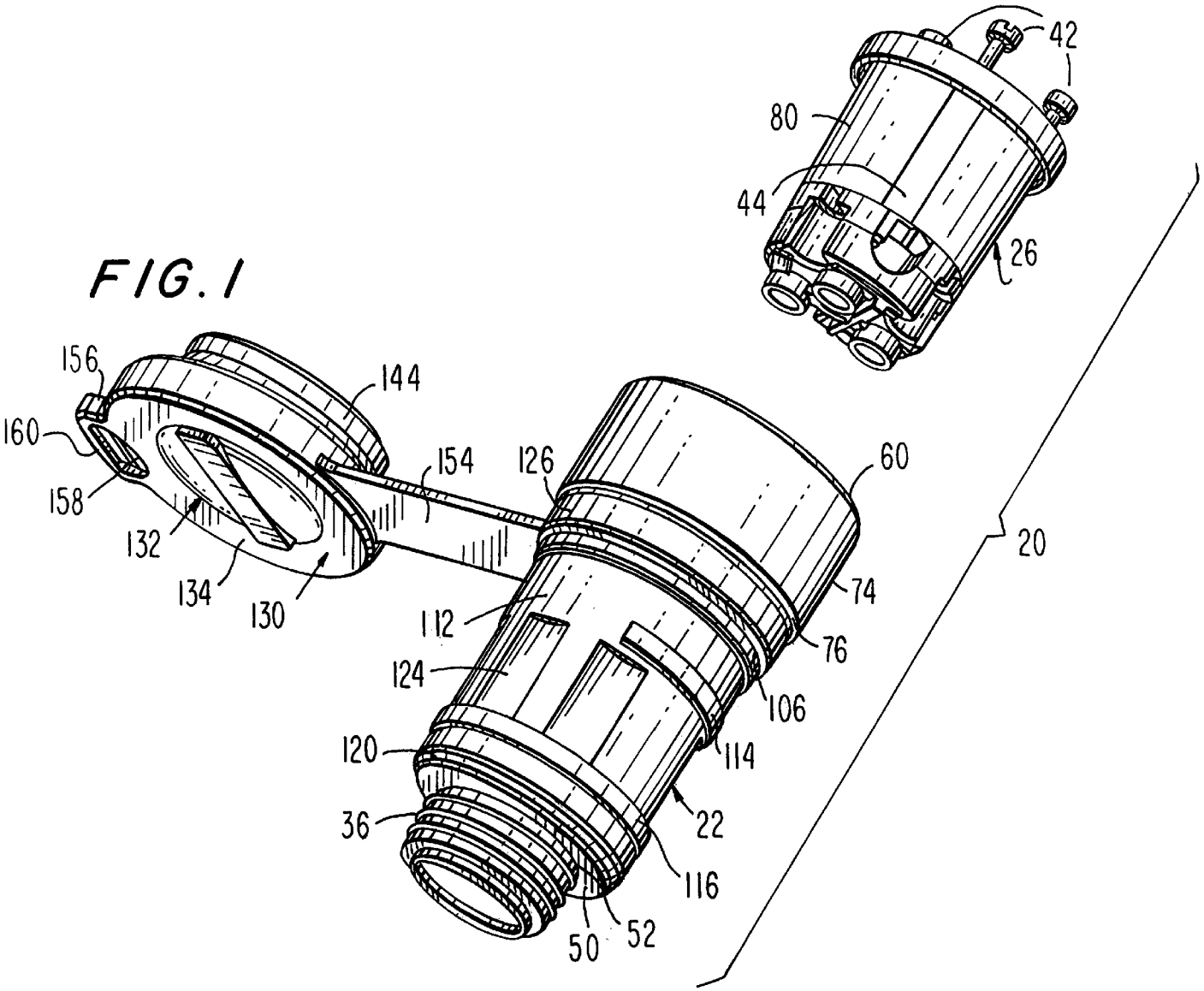
FIG. 1 is an exploded perspective view of a weather-resistant housing and mating connector according to the concepts of the instant invention.
Figure 2:
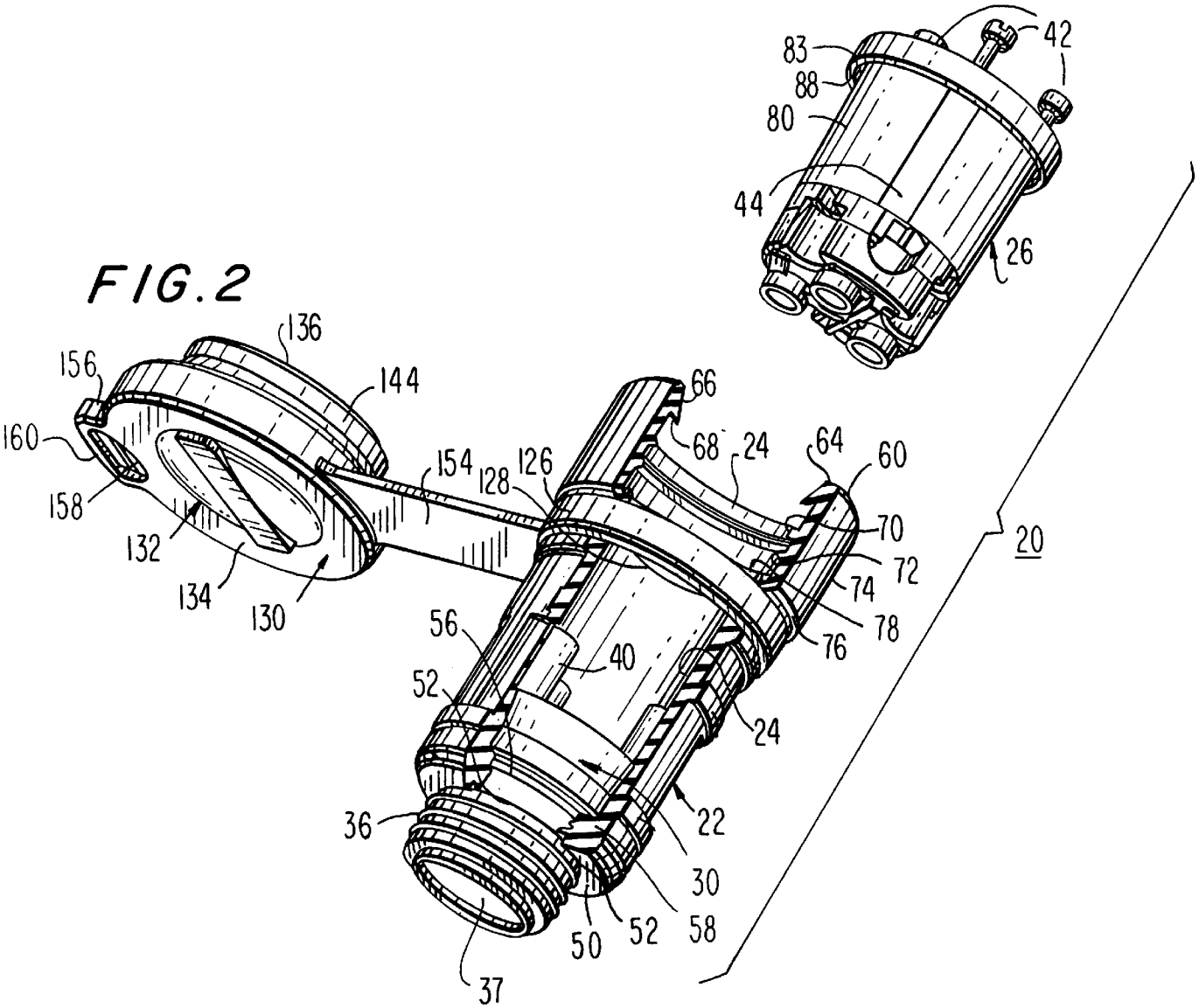
FIG. 2 is similar to FIG. 1 except that the weather-resistant housing is shown in section.
Figure 3:
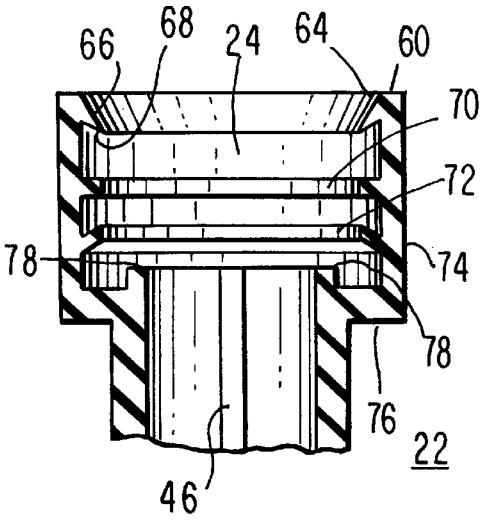
FIG. 3 is a fragmentary side elevational view, in section, of the shroud and a portion of the housing of FIG. 1.
Figure 4:
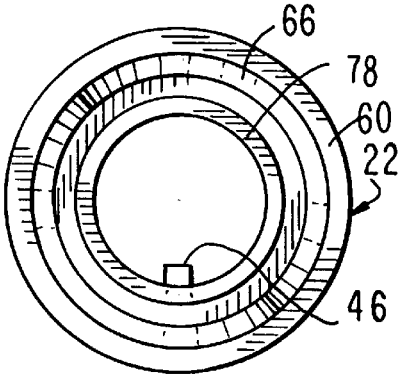
FIG. 4 is a top plan view of the housing of FIG. 1.
Figure 7:
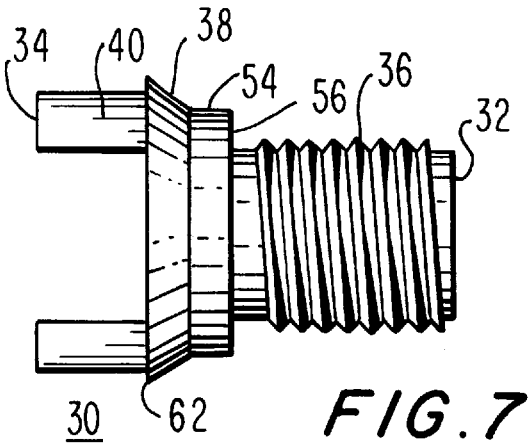
FIG. 7 is a side view of the connector support used in the instant invention and shown in position in the housing in FIG. 2.

Turning now to FIGS. 1 to 7 there is shown a water-tight connector system 20. The system 20 comprises a weather-resistant housing 22 and a connector. The connector can be a receptacle 26, as shown in FIGS. 1 and 2 or it can be a plug 28 of the type shown in FIG. 8. In either case a support 30 as shown in FIGS. 2 and 7 is employed. Support 30 has a first end 32 and a second end 34 with a bore therethrough. Adjacent first end 32 is an externally threaded portion 36 which can be mated with a water-tight strain-relieved connector through which a cable is passed into the system 20. A connector of the type which can be employed is shown in U.S. Pat. No. 4,030,741 issued Jun. 21, 1977. When placed in the partially closed end 50 of housing 22, the threaded portion 36 of support 30 extends through aperture 52 in end 50. The body of support 30 has a first cylindrical portion 54 having a diameter greater than that of threaded portion 36 to provide step 56 between these two portions. Step 56 engages the inside of the housing end wall 50. A tapered body portion 38 terminates in three cylindrical rods 40 which each contain a threaded bore (not shown) and are mounted at about 120° from one another about the periphery of body portion 38. The receptacle 26 or plug 28 partially rest on and also extend between rods 40. As can be seen in FIGS. 1 and 2, three threaded studs 42 are mounted in receptacle 26 and plug 28 to unite the support 30 and either of the receptacles 26 or plugs 28. The assembly of the receptacle 26 or plug 28 with support 30 can be carried out while such devices are inside or outside of housing 22. A ring 58 on the inside of end wall 50 about aperture 52 engages step 56 to provide a water-tight between housing 22 and support 30 and the top of ring 58 engages tapered body portion 38 which provides additional sealing. The sharp edge 62 of portion 38 of support 30 intimately engages the housing to provide additional sealing between the housing 22 and support 30.

Housing 22 is molded of weather-resistant and resilient natural or synthetic rubber, elastomeric or plastic or the like to which are added UV inhibitors and agents to keep the housing pliable. The housing 22 has a bore 24 which generally extends from a first open end 60 to a second partially closed end wall 50. As set forth above an aperture 52 in end wall 50 permits portion 36 of support 30 to pass therethrough. At the entrance to bore 24 from first open end 60 is a first annular, inwardly directed rib 64 whose leading edge is tapered as at 66 to make insertion of the connector or closure plug body easier as will be disclosed below. Rib 64 terminates in an inclined undercut 68. Two additional annular ribs 70 and 72 extend about the interior wall that defines bore 24 (see FIG. 3). Their functions will be described below. At the transition from the larger diameter shroud 74 to the diameter of substantially the remainder of the housing 22 there is a step 76. A rib 78 is formed along the inner edge of step 76 extending in parallel with and spaced apart from the wall defining the bore 24.

Figure 5:
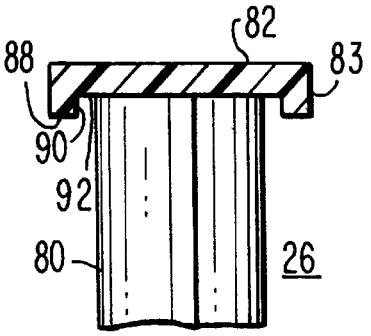
FIG. 5 is a fragmentary side elevational view, partly in section, of the connector which mates with the housing of FIG. 1.
Figure 6:
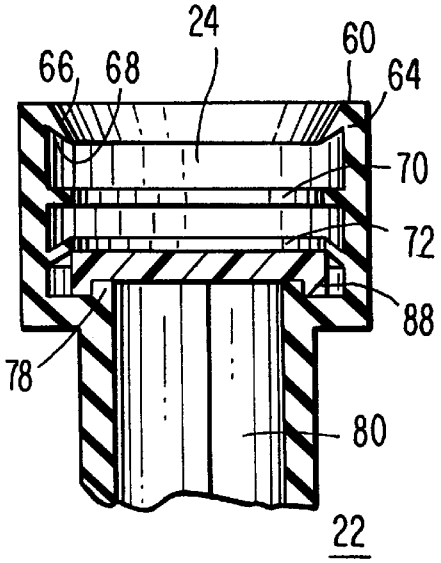
FIG. 6 is a fragmentary side elevational view, partly in section, of the connector as shown in FIG. 5 mated with the shroud and housing as shown in FIG. 3.
Figure 8:
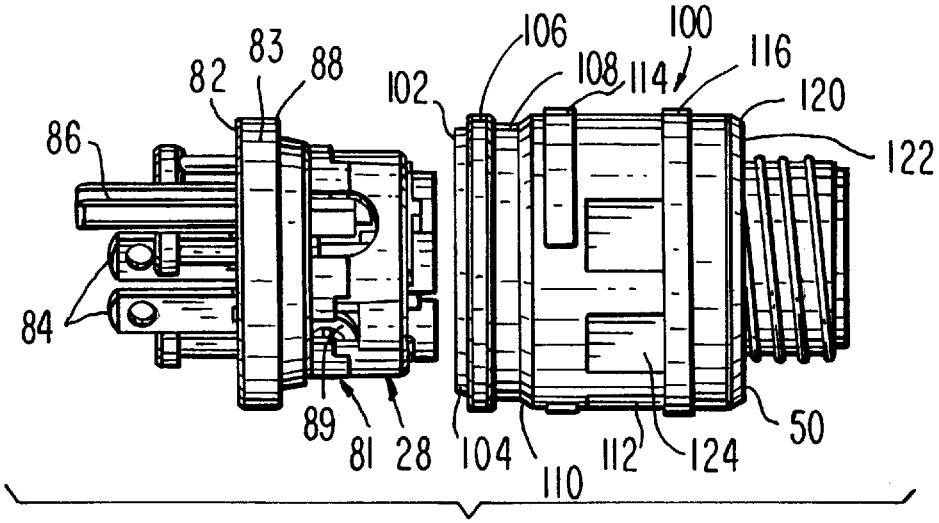
FIG. 8 is exploded view of a plug and water-tight housing which can be connected to the connector in the housing of FIGS. 1 and 2.

A typical plug 28 is shown in FIG. 8. It includes a cylindrical body 8Ø molded of insulating materials such as natural or synthetic rubber, EPDM or plastic. Projecting beyond the front face 82 are two blade contacts 84 and a semi-circular ground contact 86. The contacts extend into the body 8Ø to a contact pad to which the individual conductors of a cable (not shown) are connected by means of terminal screws (not shown) as is well known in the art. The ring 83 has a diameter greater than that of the cylindrical body 8Ø. A rib 88 is positioned at the end of the ring 83 facing the rear of the body 8Ø and parallel with and spaced apart from body 8Ø. The interior surface 90 of rib 88 and the wall of body 8Ø define an annular recess 92 as is seen in FIG. 5. The receptacle 26 of FIGS. 1 and 2 is similar to plug 28 except that it has two apertures in front face 82' (not shown) to pass a plug's flat blades 84 and one aperture (not shown) to pass the semi-circular ground contact 86 through front face 82. Below each recess is an appropriate contact to receive the blade 84 or ground contact 86 and suitably connect them to the individual conductors of a cable (not shown) using the usual terminal screws 89.

To use the water-tight connector system 20, a multi-conductor cable is passed through a strain-relief and water-tight cable connector assumed to be threadedly assembled to the threaded portion 36 of support 30 and open to permit a cable to pass therethrough. The cable passes through the bore 37 of support 30 and the bore 24 of housing 22 and beyond it. The outer cable jacket is removed for a short instance and any paper, fabric or cord insulation is removed. A short length of the individual line and neutral conductors is stripped back and installed using the terminal screws 89. The bare ground conductor is connected to the ground terminal. The support 30 and the receptacle 26 are brought into contact with each other and the threaded studs 42 are urged into the bores in cylindrical rods 40 to bring the receptacle 26 in firm contact with support 30.

The entire receptacle 26 with support 30 attached are now pushed into the bore 24 of housing 22 while the extra cable is drawn out of the bottom of housing 22. As the tapered body portion 38 strikes the rib 78, the bore 24 is stretched so that support 30 can pass beyond rib 78. The receptacle 26 is guided along the bore 24 of housing 22 and prevented from rotating by the engagement of recess 44 of the receptacle 26 with rib 46 on the side of bore 24 (see FIG. 4) from rib 78 to the closed second end 50.

As the receptacle body 80 advances in bore 24 of housing 22, the rib 88 on ring 83 of body 80 engages the inclined face 66 of rib 64 and causes the entry to bore 24 to expand. This continues until the ring 83 is beyond the bottom surface 68 of rib 64. The bore 24 can now return to its relaxed state. The rib 88 moves downwardly until it strikes the interior floor of step 76. The top of rib 78 engages the annular recess 92 of rib 88 and the surface 90 of rib 88 is urged against the inside surface of rib 78 by the rib 72 in the bore 24. The rib 72 is inclined upwardly along the longitudinal axis of the housing 22 so it pushes the surface 90 of rib 88 into firm contact with the inside surface of rib 78 but also engages the edge of front face 82 to keep the receptacle 26 from moving back towards the entrance to bore 24 (see FIG. 6). The interlock between rib 78 on the housing and rib 88 on the receptacle insure an excellent water-tight sealing between the receptacle 26 and the housing 22.

With a receptacle 26 in place in the housing 22, it is available for connection to a plug 28 which may be bare or may have a weather resistant housing 100 thereabout (as shown in FIG. 8). The interior of housing 100 is the same as described with respect to weather-resistant housing 22 except that there is no shroud 74 and ribs 64, 70 and 72 are omitted. Rib 78 is present and cooperates with rib 88 as described above to provide a water-tight seal also as described above. The exteriors of housings 22 and 100 are also the same. Beginning at first end 102 is a short cylindrical portion 104 which terminates in a raised annular rib 106. A second short cylindrical portion 108 extends from rib 106 to tapered surface 110 which ends in a third cylindrical portion 112 having an external diameter approximately equal to the external diameter of rib 106. A low annular rib 114 extends about housing 100 adjacent tapered surface 110. A second low-annual rib 116 extends about cylindrical portion 112 close to the second end 118 of housing 100. A tapered surface 120 extends between cylindrical portion 112 and the end wall 122 at the second end 118. Extending substantially from the first raised rib 114 to the second raised rib 116 are a series of depressions 124 into the surface of cylindrical portion 112 to improve the manipulation of the housing 100 by hand.

When housing 100 is introduced into the bore 24 of housing 22 cylindrical portion 104 engages the inclined surface 66 of rib 64 and causes the bore 24 to dilate. As the rib 106 moves along inclined surface 66, the bore 24 is further dilated until the rib 106 reaches a position between ribs 64 and 70. At this point the bore 24 is able to relax to its initial size. Rib 64 of housing 22 engages cylindrical portion 108 of housing 100 while rib 70 engages the surface of ring 83 to provide a water-tight seal between the housings 22 and 100. A bare plug such as shown in the left portion of FIG. 8, could be plugged into receptacle 26 to provide electrical continuity but the joint would not be water-tight.

Figure 9:
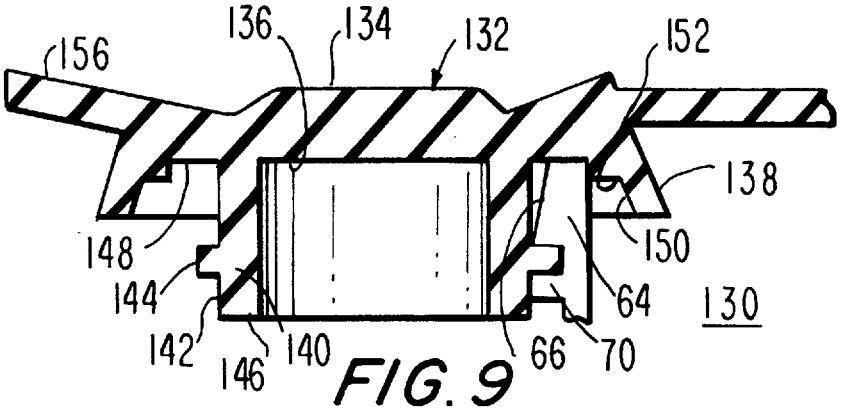
FIG. 9 is a fragmentary side elevational view, partly in section, of the closure plug of this invention as shown in FIGS. 1 and 2.

In the event that a plug 28 is removed from receptacle 26 and no further plug is to be introduced, it is possible to seal the housing 22 using a closure plug 130. The closure plug 130 is made of the same weather-resistant material as the housings 22 and 100. At a first end is a cap 132 having a top surface 134 and a bottom surface 136 and an annular lip 138 extending about the periphery of cap 132 (see FIG. 9). Connected to the bottom surface 136 of cap 132 is a central body portion 146 which is in the form of an annular ring having an outer cylindrical surface 142. A raised cylindrical rib 144 extends about cylindrical surface 142 between surface 136 and the free end 146 of body portion 140. A annular recess 148 is formed by the surface 142 of body portion 140 and the inner wall 150 of lip 138. An annular ring 152 is positioned on the floor of annular recess 148 adjacent inner wall 150.

As the free end 146 of body portion 140 engages the inclined surface 66 of rib 64 of housing 22 the bore 24 begins to dilate and continues to do so as the rib 144 engages surface 66. The bore 24 returns to its relaxed condition once rib 144 enters the space between ribs 64 and 70. At the same time the end 60 of housing 22 enters the channel 148 and proceeds therein until end 60 engages the bottom of channel 148 and in between the periphery 142 of body portion 140 and annular ring 152 which seals the entry to bore 24 and further prevents the dilation of bore 24. The engagements between surface 142 of body portion 140 and ribs 64 and 70 provide additional water seals.

At the second end of the closure plug 130 is a ring 126 having a central bore 128. Before assembly of any connector, either receptacle 26 or plug 28 into the housing 22 the closure plug 130 is installed on housing 22. Bore 128 is moved over cylindrical portion 112, over rib 116, along cylindrical portion 112 and over rib 114 and then over the final portion of cylindrical portion 112 to rib 106. The bore 128 is dilated so that ring 126 can pass over rib 106 and relax in the cylindrical body portion of housing 22 between rib 106 and the step 76 between housing 22 and shroud 74.

The ring 126 is joined to the cap 132 by a wide band or tether 154. In this way the closure plug 130 is not separated from housing 22 when it is not in use and it is always available when necessary. A tab 156 extends from annular lip 138 to permit the cap 132 to be removed from the housing 22 bore 74. A recess 158 provides a raised bar 160 which can be engaged by the thumb of the installer to facilitate removal of such closure plug 130.

While there have been shown and described and pointed out the fundamental novel features of the invention as applied to the preferred embodiment, it will be understood that various omissions and substitutions and changes of the form and details of the devices illustrated and in its operation may be made by those skilled in the art, without departing from the spirit of the invention.

The embodiments of the invention in which an exclusive property or privilege is claimed are defined as follows:

1. An insulating enclosure adapted to form a water-tight seal between an electrical connector and a housing into which said electrical connector is inserted, comprising:

a. an elongate housing of insulating material having a bore therethrough from a first open end to a second partially closed end and having an inner surface and an outer surface;

b. a step in said housing outer surface extending about a periphery of said outer surface, said step extending perpendicular to said outer surface;

c. a first annular rib extending about said step having an inner surface in line with said inner surface of said housing in a plane parallel to a central longitudinally axis of said housing said first rib being narrower than said step;

d. an elongate electrical connector having a first end and a second end and having an exterior surface adapted to closely fit within said bore of said housing; and e. an annular ring about said connector adjacent said first end, said annular ring having a second annular rib thereon extending in a direction along said longitudinal axis of said elongate electrical connector and an annular recess adjacent said second annular rib, said first annular rib entering said annular recess and said second annular rib engaging a surface of said step when said elongate electrical connector is seated within said housing to provide a water-tight seal between said housing and said elongate electrical connector.

2. An insulating enclosure, as defined in claim 1, wherein said step extends to said outer surface of said housing.

3. An insulating enclosure, as defined in claim 2, wherein said first annular rib has a rectangular cross-section.

4. An insulating enclosure, as defined in claim 3, wherein said second annular rib has a rectangular cross-section.

5. An insulating enclosure adapted to form a watertight seal between an electrical receptacle and a housing into which said electrical receptacle is inserted, comprising:

a. an elongate housing of insulating material having a first bore therethrough from a first open end to a second partially closed end and having an inner surface and an outer surface;

b. a step in said housing outer surface extending about periphery of said outer surface, said step extending perpendicular to said outer surface;

c. a shroud extending from the free end of said step and in a direction parallel with a central longitudinal axis of said housing, said shroud having a second bore therein communicating with said first bore and an inside surface and an outside surface;

d. a first annular rib extending about said step and having an inner surface in line with said inner surface of said housing in a plane parallel to said central longitudinal axis of said housing, said first rib being narrower than said step;

e. an elongate electrical receptacle having a first end and a second end and having an exterior surface adapted to closely fit within said first bore of said housing; and f. an annular ring about said elongate electrical receptacle adjacent said first end, said annular ring having a second annular rib thereon extending in a direction along said longitudinal axis of said elongate electrical receptacle and an annular recess adjacent said second annular rib, said first annular rib entering said annular recess and said second annular rib engaging a surface of said step when said elongate electrical receptacle is seated within said housing to provide a water-tight seal between said housing and said elongate electrical receptacle.

6. An insulating enclosure, as defined in claim 5, further comprising:

a. a third rib extending about said inner surface of said housing substantially perpendicular to said central longitudinal axis to engage said elongate electrical receptacle and insure engagement between said first annular rib and said second annular rib when said elongate electrical receptacle is seated within said housing.

7. An insulating enclosure as defined in claim 5, further comprising:

a. a third rib extending about said inner surface of said shroud at a first open end, said third rib reducing the diameter of said second bore at said first open end of said shroud;

b. a closure plug having a circular body portion with a diameter substantially equal to said second bore of said shroud to tightly fit within said second bore;

c. a circular cap of a diameter greater than the outside diameter of said shroud outside surface to seal said second bore of said shroud and;

d. a fourth annular rib about said closure plug body to engage said third rib to prevent said closure plug being removed from said shroud unintentionally.

8. An insulating enclosure, as defined in claim 5, wherein said step extends to said outer surface of said housing.

9. An insulating enclosure, as defined in claim 8, wherein said first annular rib has a rectangular cross-section.

10. An insulating enclosure, as defined in claim 9, wherein said second annular rib has a rectangular cross-section.

11. An insulating enclosure as defined in claim 7, wherein said third rib has an inwardly tapered surface leading into said second bore to facilitate entry of said plug body into said second bore.

12. An insulating enclosure; as defined in claim 7, wherein:

a. said circular cap has a top surface and a bottom surface and an outer periphery; and b. a second annular recess in said cap bottom surface coaxial with said outer periphery; said second recess receiving said first end of said shroud therein to provide a seal to the second bore of said shroud.

13. An insulating enclosure as defined in claim 7, further comprising;

a. a fifth rib extends about said inner surface of said housing spaced apart from said third rib towards said second partially closed end; said fifth rib engaging said closure plug body portion beyond said fourth annular rib to provide a further seal between said shroud and said closure plug.

14. An insulating enclosure as defined in claim 12, wherein said third rib has an inwardly tapered surface leading into said second bore to facilitate entry of said plug body into said second bore.

15. An insulating enclosure as defined in claim 12, further comprising:

a. pull tab extending outwardly from said periphery of said cap to facilitate removal of said closure plug from said housing bore.

16. An insulating enclosure as defined in claim 12, further comprising:

a. a tether extending outwardly from said periphery of said cap; and b. means coupled to the free end of said tether to retain said closure plug with said housing when said closure plug has been removed from said housing bore.

17. An insulating enclosure as defined in claim 15, wherein:

a. said pull tab has a recess in the top surface thereof to provide a transverse gripping surface to facilitate removal of said closure plug from said second bore.

18. An insulating enclosure as defined in claim 13, further comprising:

a fifth rib extending about said inner surface of said shroud spaced apart from said third rib towards said second partially enclosed end; said closure plug body portion engaging said fifth rib to provide a further seal between said shroud and said enclosure plug.

* * * * *